US007137349B2

(12) United States Patent
Morelock et al.

(10) Patent No.: US 7,137,349 B2
(45) Date of Patent: Nov. 21, 2006

(54) KICKDOWN CATAMARAN

(76) Inventors: David Morelock, 9228 Mast Blvd., Santee, CA (US) 92071; Michael Morelock, 11419 Madera Cir. SW., Lakewood, WA (US) 98499

( * ) Notice: Subject to any disclaimer, the term of this patent is extended or adjusted under 35 U.S.C. 154(b) by 0 days.

(21) Appl. No.: 10/606,975

(22) Filed: Jun. 24, 2003

(65) Prior Publication Data

US 2004/0261678 A1 Dec. 30, 2004

(51) Int. Cl.
*B63B 7/02* (2006.01)
*B63B 1/10* (2006.01)
*B63H 9/00* (2006.01)

(52) U.S. Cl. ..... 114/354; 114/39.26; 114/61.1

(58) Field of Classification Search ..... 114/352–354, 114/39.26, 39.27, 39.28, 61.1, 61.15, 61.22, 114/61.23, 283, 292
See application file for complete search history.

(56) References Cited

U.S. PATENT DOCUMENTS

| | | | | | |
|---|---|---|---|---|---|
| 3,141,435 | A * | 7/1964 | Moffitt Jr. | ..... | 114/39.26 |
| 3,986,219 | A * | 10/1976 | Michowski | ..... | 114/354 |
| 4,136,414 | A * | 1/1979 | Popkin | ..... | 114/345 |
| 4,348,971 | A * | 9/1982 | Montgomery | ..... | 114/61.23 |
| 4,401,047 | A * | 8/1983 | Auras | ..... | 114/39.25 |
| 4,406,239 | A * | 9/1983 | Enzmann | ..... | 114/39.26 |
| 4,528,925 | A * | 7/1985 | Pyburn | ..... | 114/61.23 |
| 4,621,587 | A * | 11/1986 | Pool | ..... | 114/39.26 |
| 4,766,830 | A * | 8/1988 | Kunz | ..... | 114/39.26 |
| 4,796,555 | A * | 1/1989 | Chang | ..... | 114/39.26 |
| 4,856,446 | A * | 8/1989 | Herard | ..... | 114/61.22 |
| 4,915,047 | A * | 4/1990 | Lord et al. | ..... | 114/39.26 |
| 5,042,411 | A * | 8/1991 | Krolczyk | ..... | 114/39.26 |
| 5,630,371 | A * | 5/1997 | Morrelli et al. | ..... | 114/61.23 |
| 6,546,885 | B1 * | 4/2003 | Francke | ..... | 114/61.15 |

FOREIGN PATENT DOCUMENTS

| | | | |
|---|---|---|---|
| EP | 106932 | A1 * | 5/1984 |
| FR | 2579953 | A1 * | 10/1986 |
| GB | 2024112 | A * | 1/1980 |
| GB | 2030946 | A * | 4/1980 |
| GB | 1575514 | A * | 9/1980 |
| GB | 2171652 | A * | 9/1986 |
| JP | 56160286 | A * | 12/1981 |
| JP | 2002240781 | A * | 8/2002 |
| RU | 2092372 | C * | 10/1997 |
| SU | 1675155 | A * | 9/1991 |
| WO | WO 8808804 | A1 * | 11/1988 |

* cited by examiner

*Primary Examiner*—Ajay Vasudeva
(74) *Attorney, Agent, or Firm*—David L Tingey

(57) ABSTRACT

A kick down and kick up catamaran assembles by hand with holes in main spar and stern spar ends receiving threaded rods extending vertically from the side-by-side hulls, secured in place with hand knobs. A bow spar with a line to the mast lifts the mast to vertical and is then secured between the hulls. A mast operationally rests with its proximal end alongside the main spar, held in place by an easily removable cord that wraps the main spar and slips into a mast slot opening at the mast proximal end. A trampoline stretches between the main and stern spars providing a platform on which the operator sits, tightened by a plurality of adjustable straps between the trampoline and the stern spar.

9 Claims, 10 Drawing Sheets

KICKDOWN CATAMARAN

BACKGROUND

1. Field of the Invention

This invention relates to catamarans, and more specifically to a catamaran characterized by facile assembly and kick down by hand and employing an underwater relief-tolerant rudder.

2. Prior Art

It is well known to have catamarans comprising a pair of parallel hulls, a mast supported by a main spar between the hulls, and platform between the hulls on which to ride. It is also well-known to have retractable rudders on sailboat sterns operated by a tiller that avoids damage to the rudder when it might impact an underwater object or change in underwater relief. It is also known to have retractable rudders that lift completely out of the water. For catamarans, it is also known to operate the tiller of each rudder from a common helmsman position.

The present invention presents such a catamaran that can be assembled from components without tools using only hand-turned knobs and straps. Likewise, the catamaran can be broken down quickly and easily without tools for ease in assembly and disassembly for convenient transport of the vessel. Assembly can be easily done by one person, including raising and lowering the main mast with a sail attached. It also presents a rudder useful on each hull of such a catamaran that lifts and lowers to track underwater terrain or objects automatically but can be lifted completely out of the water by a single helmsman by simply pulling back on an arm linked to both tillers.

SUMMARY

Common to catamarans, this catamaran includes left and right hulls joined by a main spar and a stern spar. Threaded rods extending vertically from the hulls, two at each spar end to maintain the hulls aligned side by side, pass through matching holes in the spar ends. A hand knob on each spar end with a threaded hole matching the threaded rods secures the spars over the respective rods, hand tightened by the operator.

A bow spar doubles as a main sail lift line. A bow mast line is attached between the mast and the bow and two stern mast lines are attached between the mast and the stern spar, spaced apart. The mast with its main sail attached is therefore raised after the main and stern spars are secured onto the hulls simply by pulling the bow stern forward into place on the hull, typically under forward-facing hull hooks, the three lines then maintaining the mast vertical until the bow spar is released upon which it lowers the mast under control from vertical to horizontal It is seen then that the catamaran is quickly and easily assembled and broken down by catch or release of the bow spar and hand tightening or untightening of the spar knobs without tools. With the spars removed from the catamaran, the components are amenable for facile loading and transport.

The mast that operationally rests with its end on the main spar is held in place by an easily removable cord. A slit in the mast at its proximal end receives the cord loop after it is wrapped around the main spar with a loop knot or other enlargement of the cord past the slit and inside of the mast. The cord then supports the mast alongside the main spar. The cord typically is in a closed loop attaching the mast proximal end to the main spar by wrapping a lead portion of the loop from a main spar mast side around the main spar and back to the main spar mast side passing through a tail portion of the loop and then through the mast slot, the lead portion of the loop being releasably fastened in the mast slot, securing the mast proximal end alongside the main spar. A ball on the lead portion of the loop larger than the mast slot then fastens the loop lead portion in the slot by passing the lead portion of the loop under the mast and upward into the slot, the loop passing through the slot from the ball on one slot side to the main spar on the opposite slot side.

A trampoline stretched between the main and stern spars provide a platform on which the operator sits. A plurality of adjustable straps extends from the trampoline toward the stern spar, adjustably connecting to matching strap fasteners on the stern spar. The trampoline is tightened between the main spar and the stern spar by adjusting the length of the plurality of stern spar straps A stabilizing rod in a tube, along the straps on the trampoline stabilizes the trampoline by distributing the tension from tightened straps along the trampoline edge presented to the stern spar. At least two jib attachment straps are also sewed into the trampoline as a hold for a catamaran jib during sailing.

A rudder is mounted on each hull that traces the underwater relief or objects as they might impact the rudder distal end. The rudder rotates rearward on a horizontal axis about a pivot pin on a mounting plate as the catamaran moves forward as it impacts an underwater object. The mounting plate mounted to the hull itself hinges about a vertical axis to steer the vessel. A control plate is pivotally attached to the rudder near its top on one end, typically below and rearward of the rudder attachment to the mount plate, and rigidly to a tiller on its opposite end such that when the tiller is pulled it lifts the rudder intermediate the rudder as the rudder upper end pivots about the horizontal axis at the rudder upper end. A tiller arm bridges between unattached ends of the tiller such that lateral movement of the tiller arm causes both rudders to pivot from the hinged attachment of the mount plate to the stern in steering the vessel.

The tiller comprises a first tube telescoping from a second tube and a spring in the second tube in stretched condition urging the first tube into the second tube. The spring tends to urge the rudder forward into the down position with the control plate in contact the mount plate. Yet when the rudder impacts on object, it rotates upward with the rudder distal end moving away from the stern as the first tube telescopes into the second tube against the spring bias.

The rudder is maintained in operational position as it rotates upward and downward through an inclined runner at the mount plate top that faces the stern. A guide on the tiller rests in a groove at the base of the runner when the rudder is vertical. As the rudder rotates away from its downward, operational position, the guide slides up the runner. After the rudder passes the object it impacted that caused it to raise, the guide sliding down the runner into its rest position in the groove guides it back into vertical position. When the rudder is lifted out of the water by the operator., the runner lifts past the runner as the tiller is pulled back and locked onto the hull until released, upon which the operator moves the guide once again against the runner to guide the rudder back into the water.

DETAILED DESCRIPTION OF THE PREFERRED EMBODIMENTS

Figure 1:
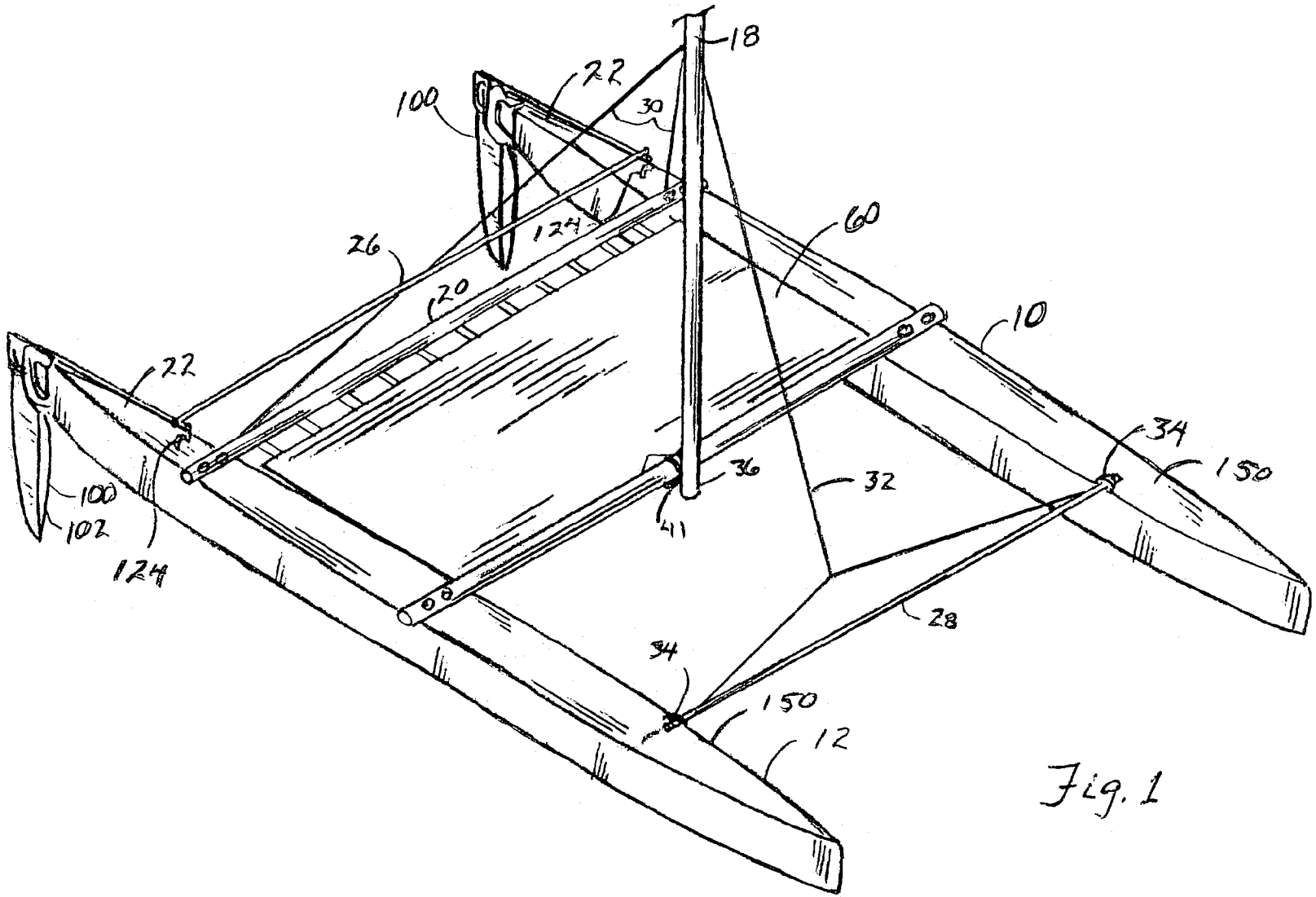
FIG. 1 is a front perspective view of the assembled catamaran.
Figure 2:
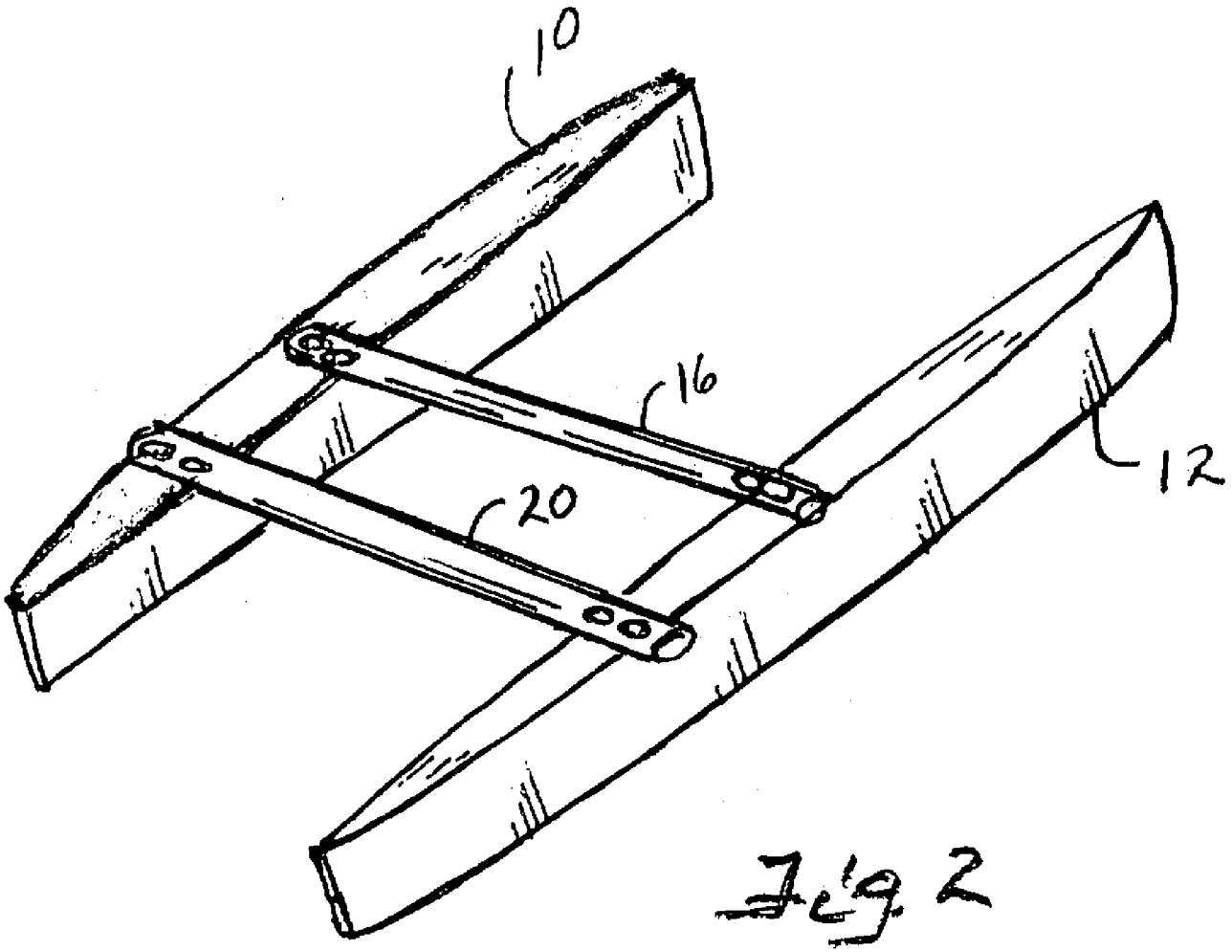
FIG. 2 is a rear perspective view of the catamaran partially assembled showing aligned hulls joined by main and stern spars.
Figure 3:
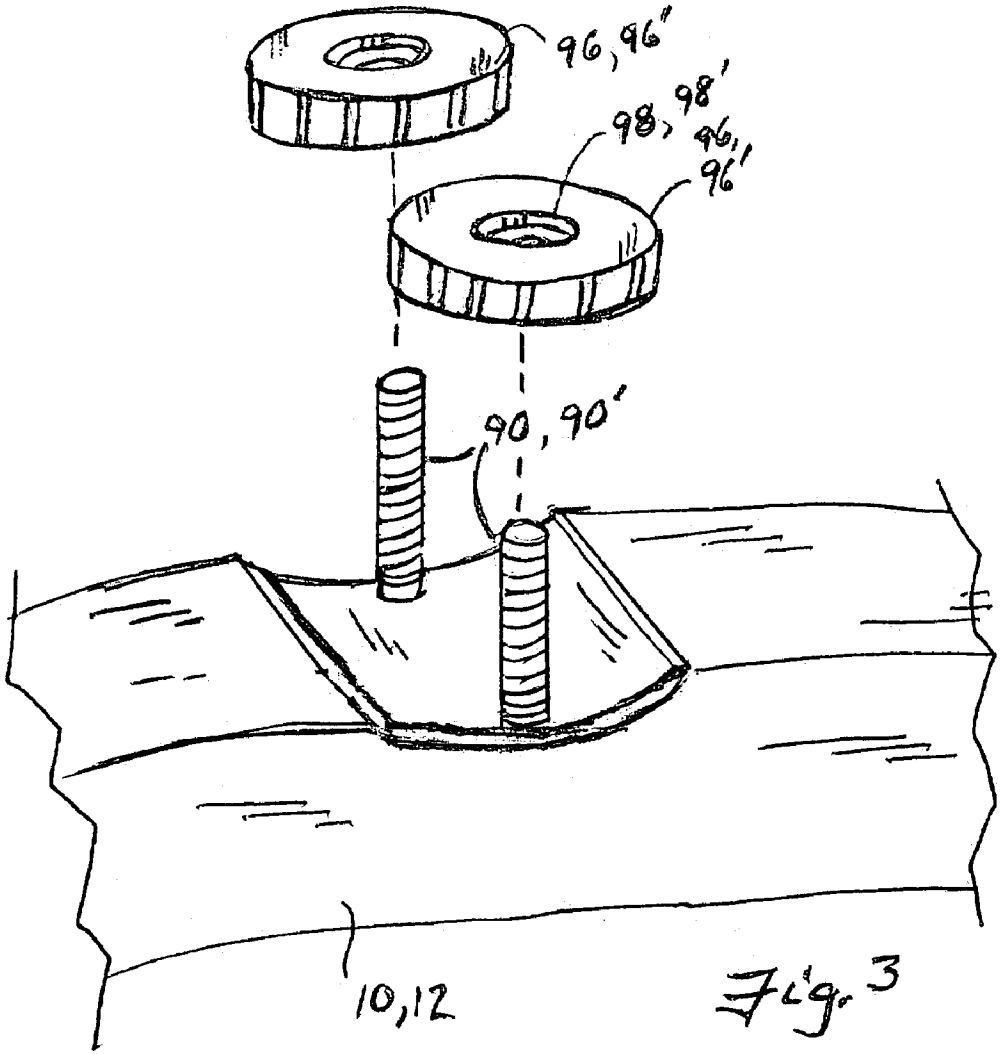
FIG. 3 is an perspective view of threaded rods vertical from the hulls and matching knobs ready to receive a spar therebetween.
Figure 4:
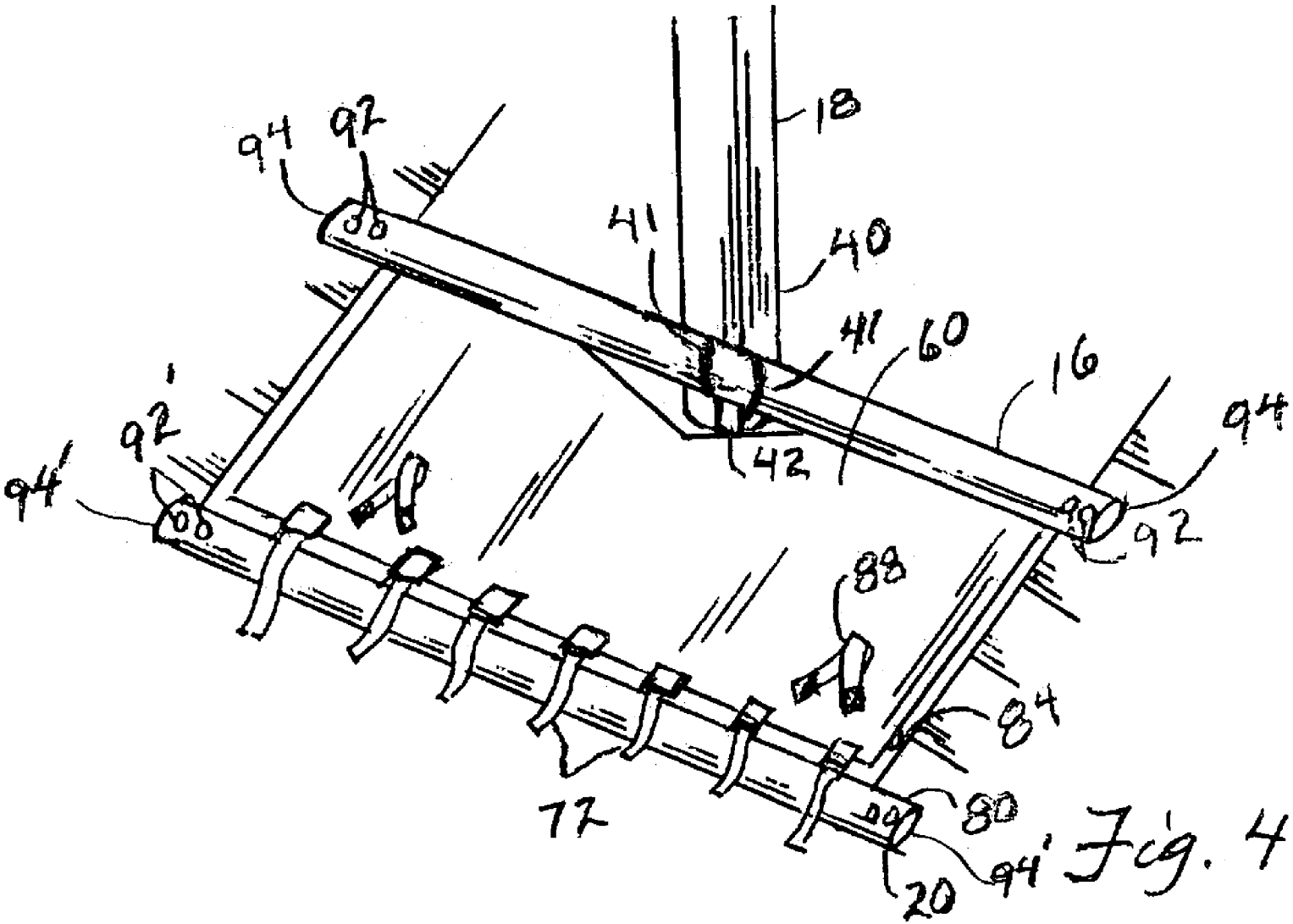
FIG. 4 is a perspective view of the trampoline stretched between the main spar and the stern spar by attaching straps.
Figure 5:
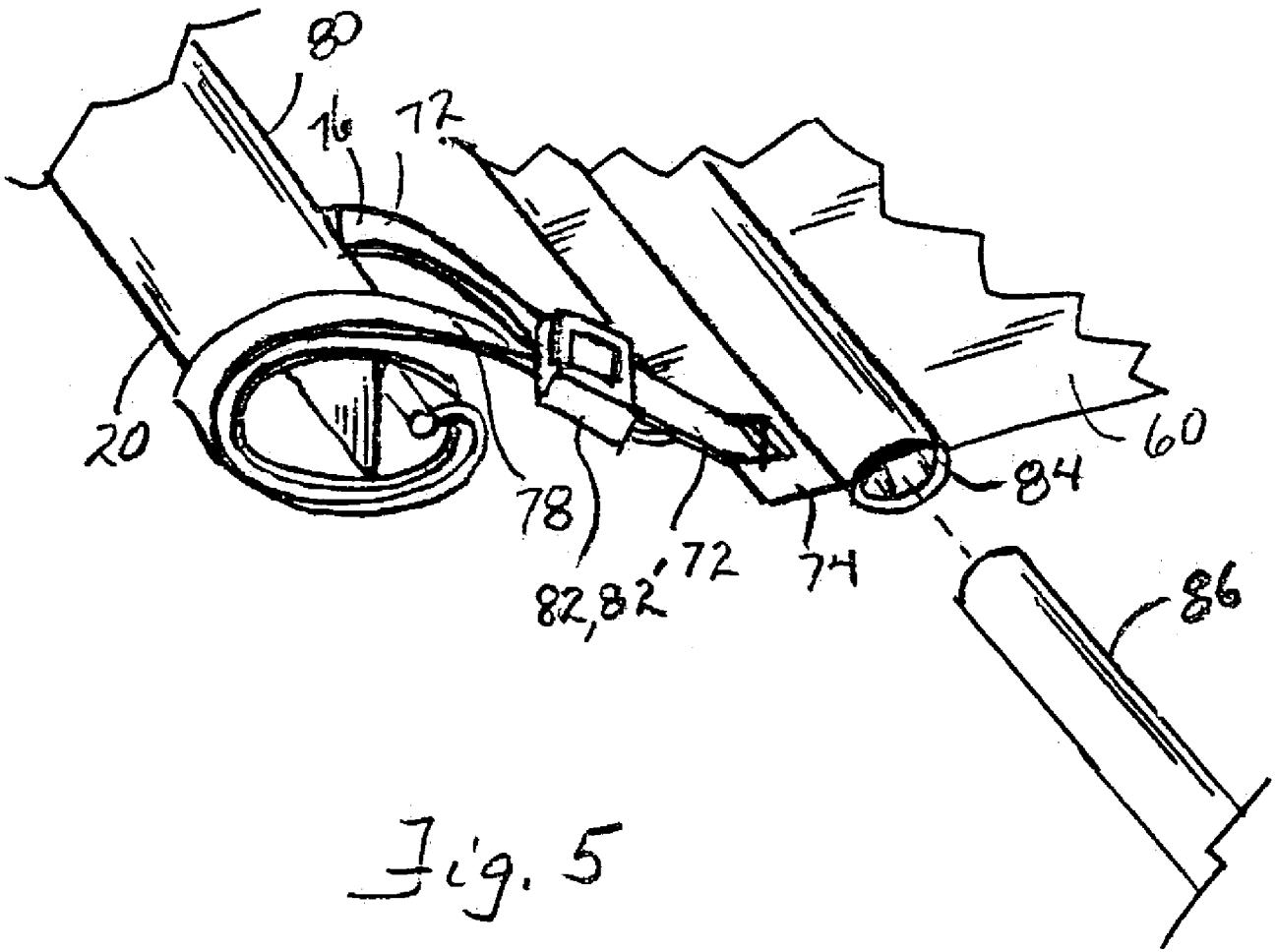
FIG. 5 is a perspective of the trampoline attached to the stern by straps with a dowel in a trampoline loop for distributing load from the straps to the trampoline uniformly.
Figure 6:
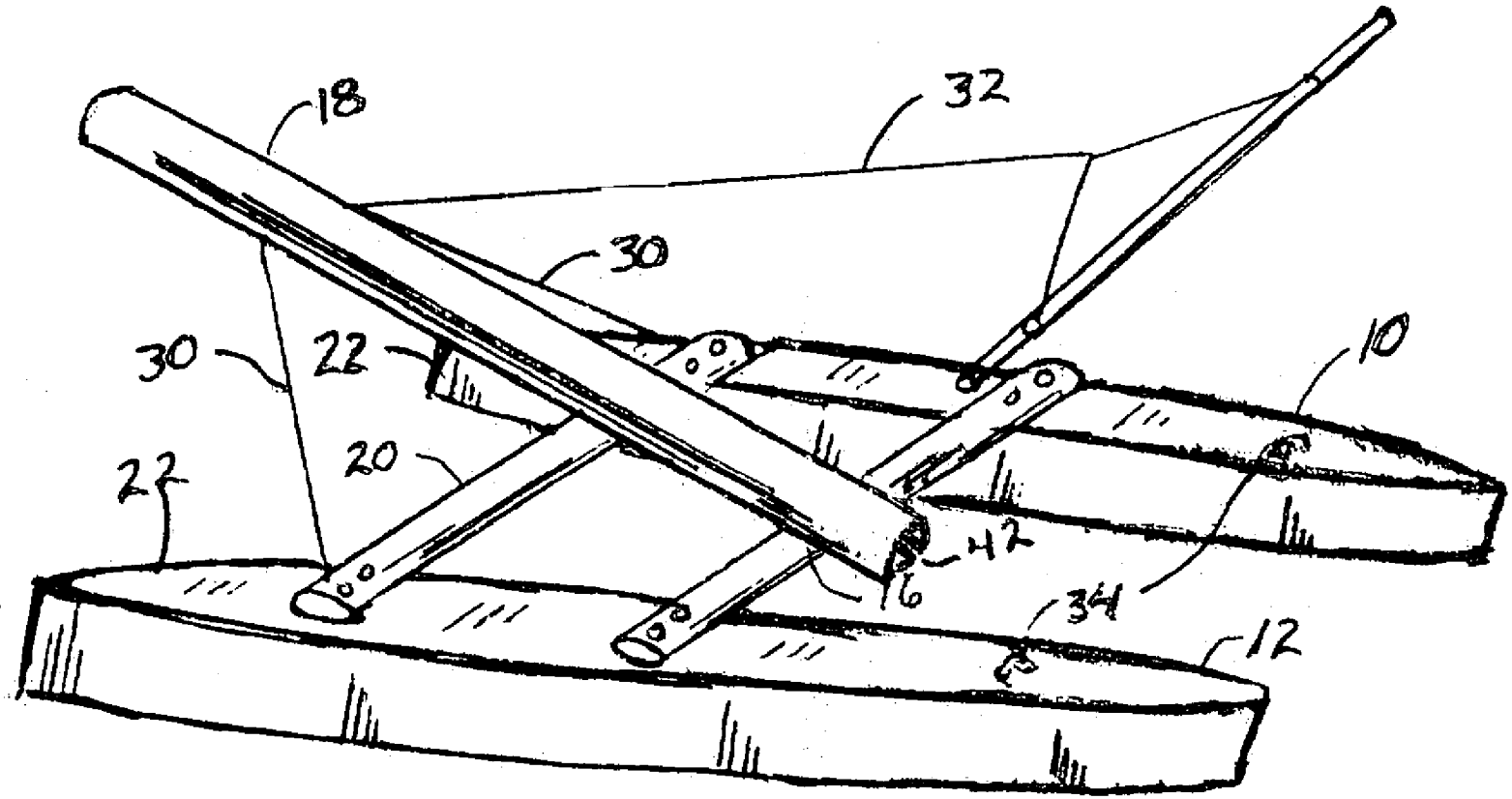
FIG. 6 is a perspective view of the partially assembled catamaran showing the mast partially raised by pulling of the bow spar forward toward engagement with forward facing hull hooks.
Figure 7:
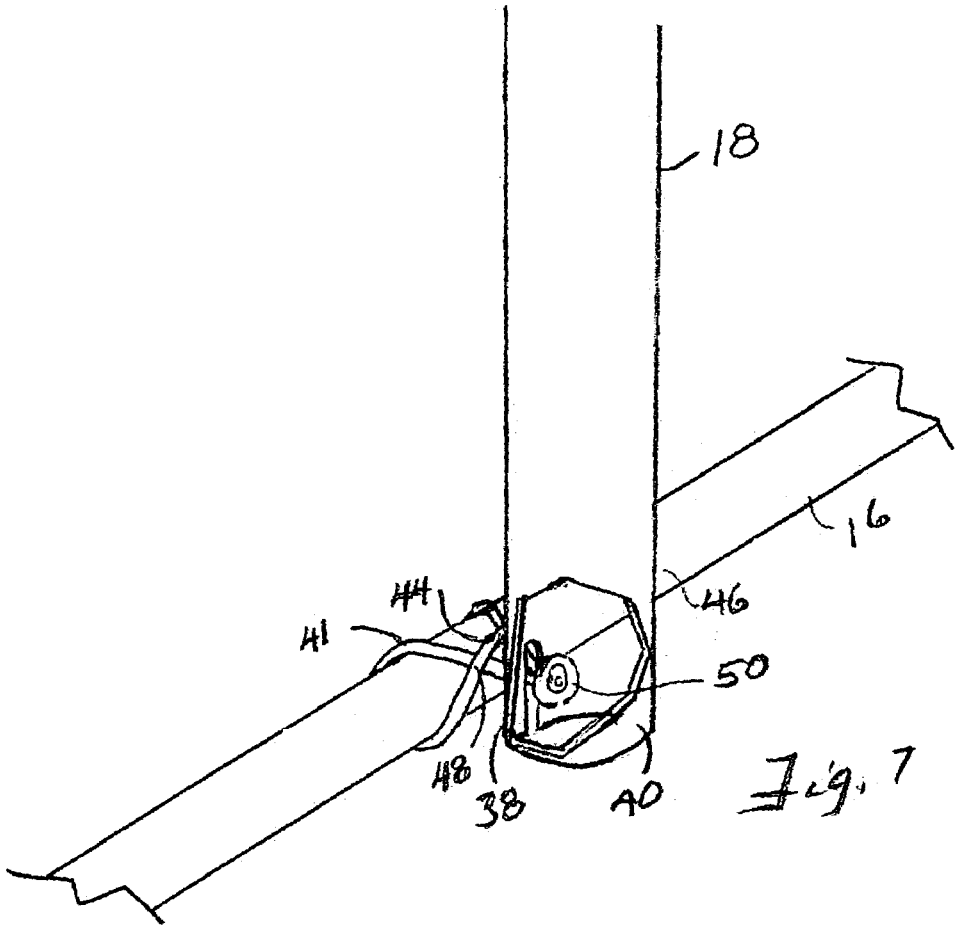
FIG. 7 is a perspective view of the mast alongside the main spar secured by a cord in a mast slot at its proximal end.
Figure 8:
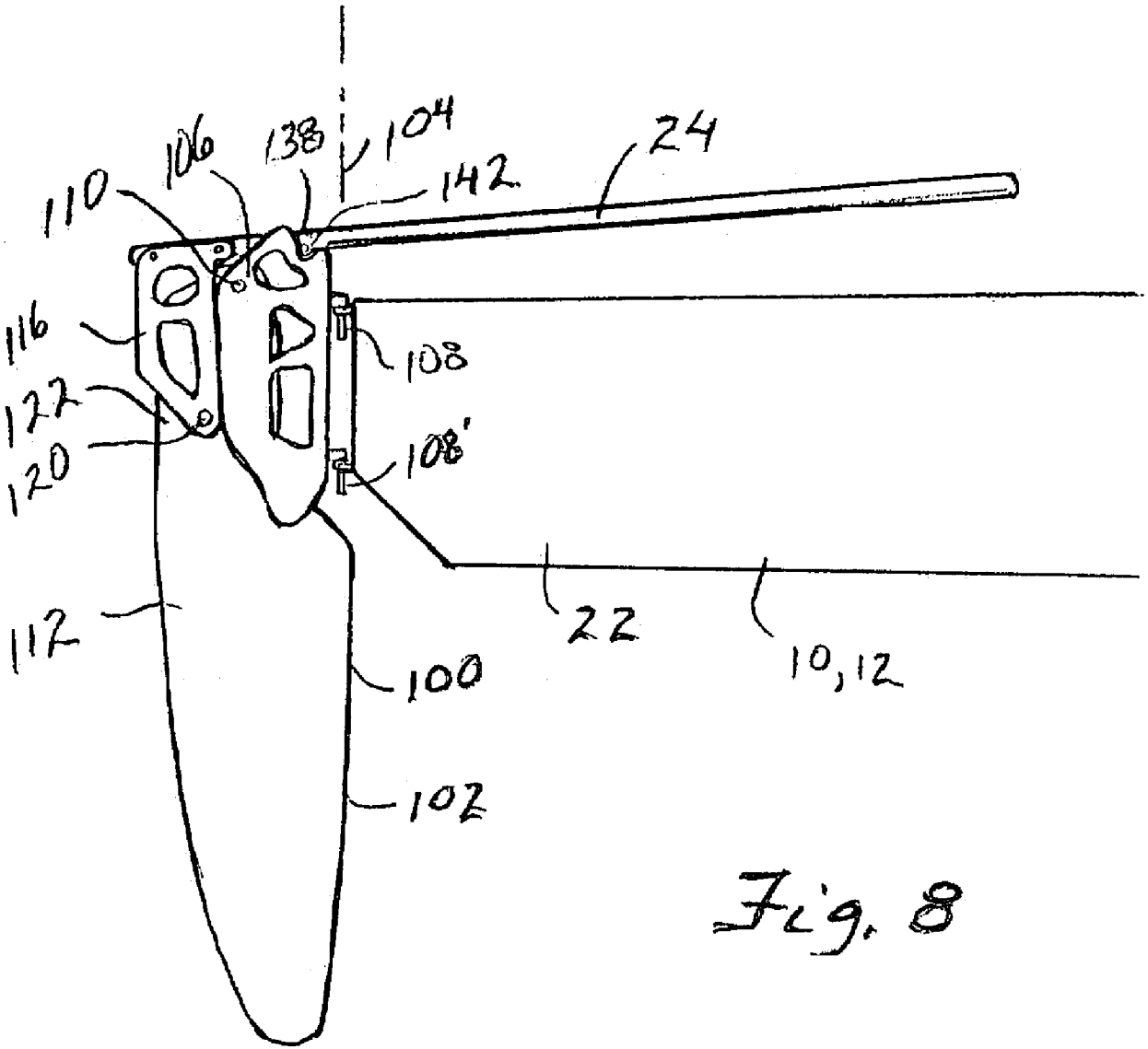
FIG. 8 is a side view of the rudder assembly showing the rudder in downward position.
Figure 9:
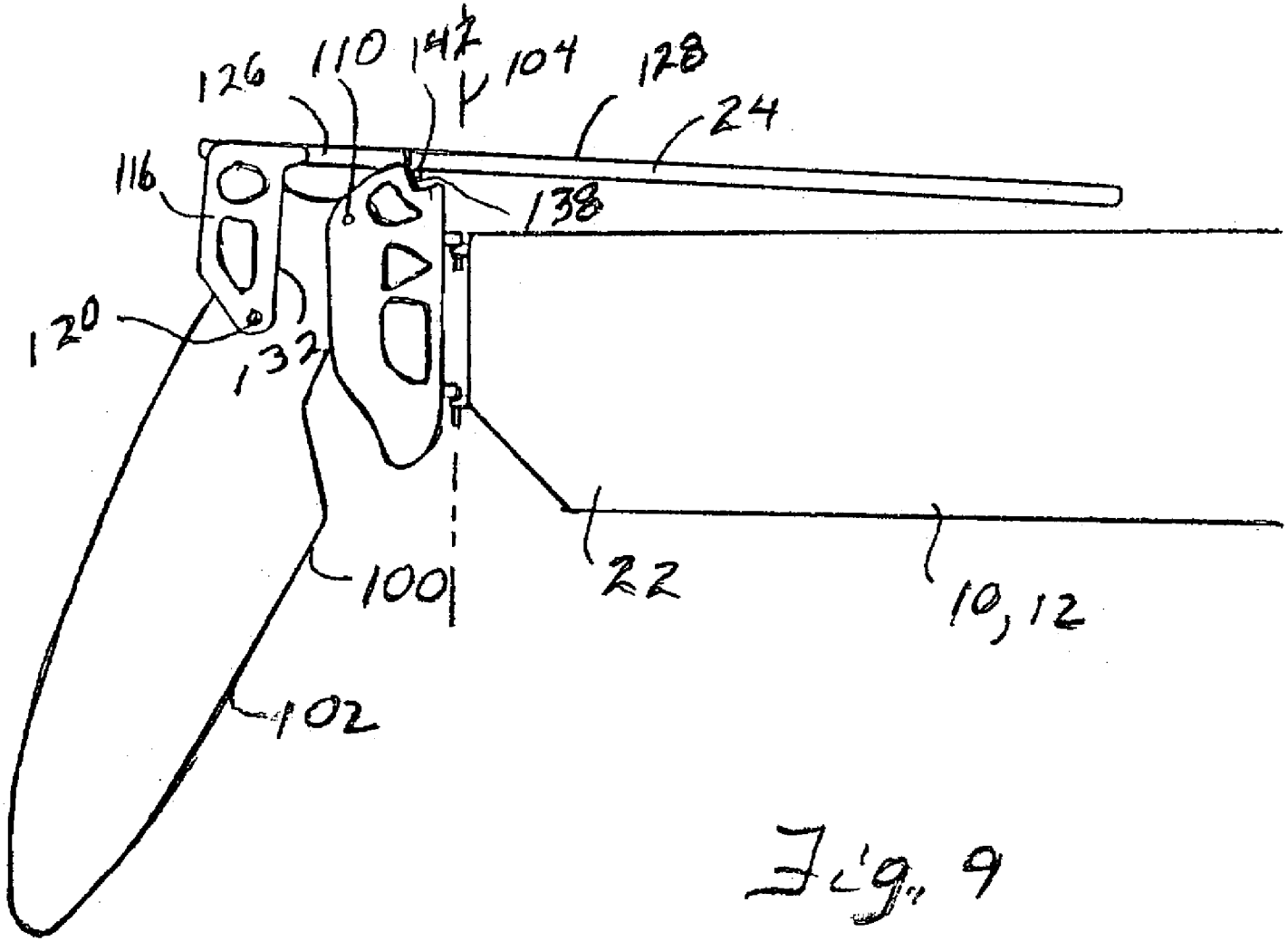
FIG. 9 is a side view of the rudder assembly showing the rudder partially raised.
Figure 10:
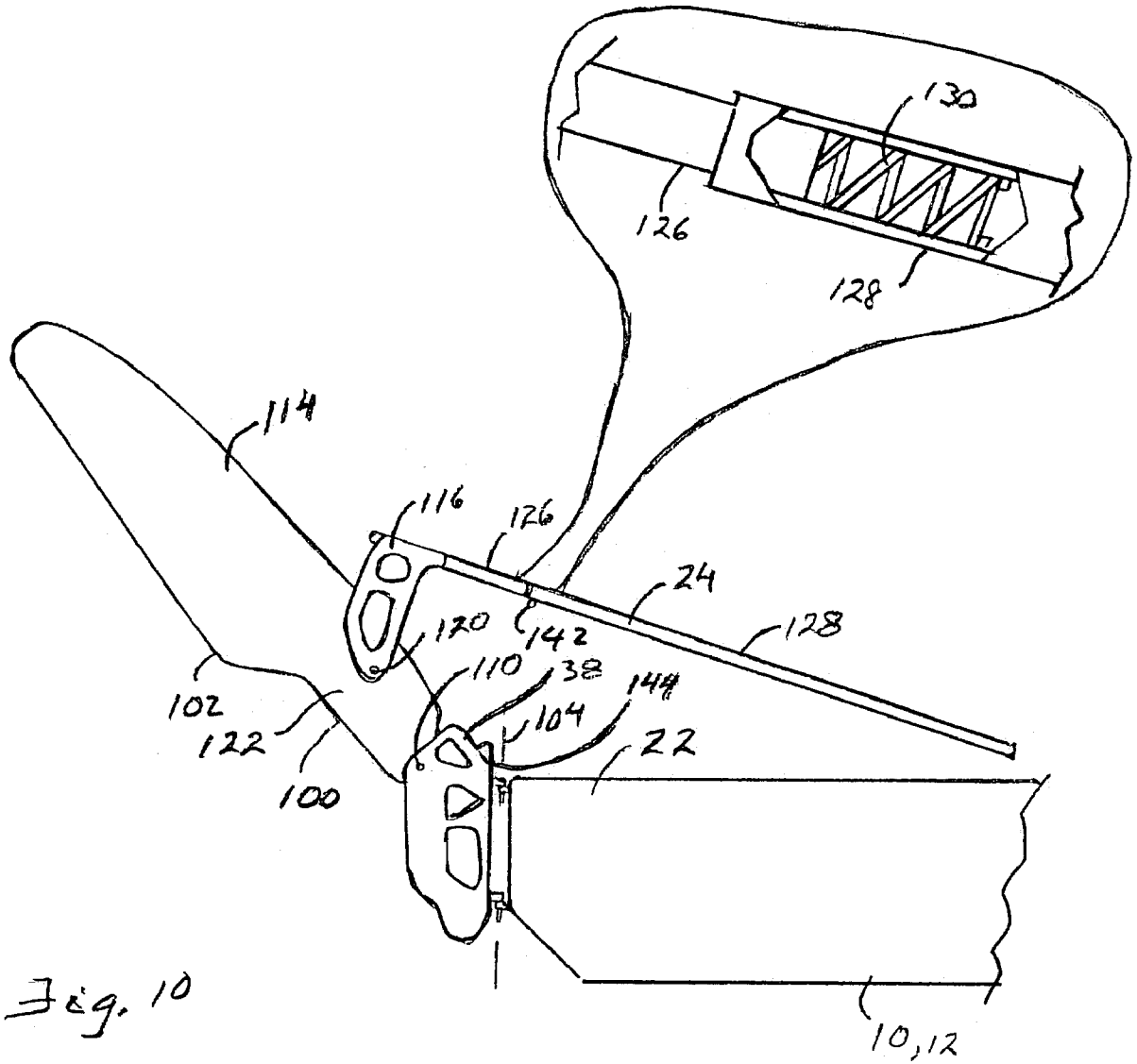
FIG. 10 is a side view of the rudder assembly showing the rudder raised out of the water by action of the tiller pulling the rudder up with the tiller engaged in forward facing hull hooks.

The catamaran of the present invention is adapted for quick and easy kick up and kick down without tools. Characteristic to catamarans, it comprises left and right hulls 10 and 12 aligned side by side in parallel, a main sail (not shown) on a mast 18, a jib (not shown), and a rudder assembly 100.

A main spar 16 releasably connects the two hulls at the center of the hulls and a mast 18 is removably attached thereto. A stern spar 20 also releasably connects the two hulls 10 and 12 astern from the main spar 16. A trampoline 60 stretches between the main and stern spars 16 and 20 as a platform. The rudder assembly 100 attaches removably to each hull stern 22 with a tiller 24 extending from each rudder 102 toward the stern spar 20. A tiller arm 26, also removable without tools, interconnects the tillers 24 at their distal ends such that lateral movement of the tiller arm 26 causes the rudders 102 to move on their vertical axes 104. A bow spar 28 also releasably connects the two hulls 10 and 12 of the catamaran forward from the main spar 16. Stern lines 30 connect between each of the first and second hulls 10 and 12 sternward of the main spar 16 and the mast 18 intermediate its length and spaced apart from the main spar 16. Similarly, a bow line 32 connects between the mast 18 also intermediate its length and the bow spar 28 such that during catamaran assembly the bow spar 28 pulls the mast 18 attached to the main spar 16 at its proximal end 40 from horizontal to vertical and then connects to the hulls on hull hooks 34 forward of the main spar 16. The three lines then maintain the mast 18 vertical until the bow spar 28 is released upon which it lowers the mast 18 under control from vertical to horizontal.

For facilitating attachment to the main spar 16, the mast 18 includes a mast vertical slot 42 on one mast side 38 opening at the mast proximal end 40, longitudinal with the mast 18. A cord 41, typically in a closed loop, attaches the mast proximal end 40 to the main spar 16 by wrapping a lead portion 44 of the loop from a main spar mast side 46 around the main spar 16 and back to the main spar mast side 46 passing through a tail portion 48 of the loop and then through the mast slot 42. As the mast 18 rests vertically alongside the main spar 16, the lead portion 44 of the loop is releasably fastens in the mast slot 42, securing the mast 18 alongside the main spar 16. A ball or knot 50 on the lead portion 44 of the loop larger than the mast slot 42 may be employed to fasten the loop lead portion 44 in the slot 42 by passing the lead portion 44 of the loop under the mast 18 and upward into the slot 42, the loop passing through the slot 42 with the ball 50 on the slot side opposite the main spar 16.

The trampoline 60 is affixed to the main spar 16 and then stretched to the stern spar 20 during catamaran assembly. A plurality of trampoline straps 72 extends from the trampoline rearward edge 74 and end in a fastener first part 76. A plurality of stern spar straps 78 extend from a stern spar forward edge 80 and end in a fastener second part 82, typically a strap buckle 82', through which the trampoline strap 72 passes, pulling the strap tight, and stretching the trampoline 60 between the main and stern spars 16 and 20, as it is secured in the buckle 82', the trampoline 60 tightened between the main spar 16 and the stern spar 20 by adjusting the effective length of the plurality of stern spar straps 78. To distribute tension from the plurality of straps across the trampoline rearward edge 74, a trampoline tube 84 at the trampoline rearward edge 74 has a rod or dowel 86 running through it. To receive a jib (not shown), at least one looped jib strap 88 is provided sewn into the trampoline 60 into which the jib can be quickly inserted and removed manually.

To attach the main spar 16 to the hulls 10 and 12, a first set of two threaded rods 90 extend upward from each hull and matching holes 92 in the main spar ends 94 fit over the rods 90. Main spar knobs 96 with threaded holes 98 that match the threaded rods 90 are hand-tightened removably to secure the spar thereon for quick kick up and down by hand. Similarly, to attach the stern spar 20 to the hulls 10 and 12, a second set of two threaded rods 90' extend upward from each hull and matching holes 92' in the stern spar ends 94' fit over the rods 90'. Stern spar knobs 96' also with threaded holes 98' that match the threaded rods 90' are hand-tightened to secure the spar thereon. It should be understood that this description of knob on a rod, in the specification and the claims, is meant to be construed liberally to include any other hand operated clamping or tightening means, such as a cam clamp, strap and buckle, fastener, eye and hook tape, rod and cotter pin, and other functionally similar or equivalent mechanisms or mechanisms achieving the same result.

The catamaran rudder assembly 100 comprises a common rudder 102 mounted on each hull 10 and 12 to pivot on a vertical axis 104 in steering the catamaran. The improvement comprises a mounted plate 106 mounted pivotally to each hull stern 22 on upper and lower vertical pins 108 and 108' as a hinge. The rudder 102 mounts to the mounting plate 106 pivotally about a first horizontal axis 110 enabling the rudder 102 to move between a lowered, or vertical, position 112 and raised position 114 with the rudder 102 out of the water, or above the hull.

A control plate 116 attaches between a tiller 24 and the rudder 102. The tiller 24 is rigidly attached to the control plate 116 and the rudder 102 is pivotally attached about a second horizontal axis 120 at the rudder proximal, or upper, end 122. So that a pull by the tiller 24 raises the rudder 102, the first horizontal axis 110 is above and forward from the second horizontal axis 120 when the rudder 102 is in its lowered position 112. Thus, an operator can rotate the rudder 102 up by pulling the tiller 118. A hook 124 is provided on the hull stern 122 directed away from the rudder 102 to which the tiller 24 may be secured to hold the rudder 102 in its raised position.

The rudder 102 is also free to rotate independent of operator action on the tiller 24 as it impacts an object or underwater relief in shallow waters causes the rudder 102 to rotate to avoid damage to it. In doing so, the rudder pivots on both first and second horizontal axes 110 and 120 raising the second horizontal axis 120 and the control plate 116 relative to the first horizontal axis 110 and the mounting plate 106. To accommodate rudder rotation, the tiller 24 comprises a tubular inner member 126 telescoping from a tubular outer member 128 with a spring 130 in the outer member 128 biasing the inner member 126 into the outer member, urging the rudder 102 to its lowered position and accepting rudder rotation as the inner member moves into the outer member against the spring bias.

The control plate 116 includes an interface surface 132 that engages the mounting plate 106 and stops downward rotation of the control plate 116 at the rudder lowered position.

To guide the rudder 102 as it rotates upon impact against its distal end, an inclined runner 138 is provided on the mounting plate 106 at its top 140 facing generally toward the stern 22. A guide 142 on the tiller 24 slides on the runner 138, resting in a groove 144 at the base 146 of the runner 138 when the rudder 102 is in its lowered position. As the rudder 102 rotates, it lifts the tiller 24 and the guide 142 slides on the runner 38. As the rudder 102 returns to its lowered position under bias of the spring 130, the guide 142 slides on the runner 138 back to the groove 144. If the rudder 102 rotates such that the guide 142 is lifted above the runner 138, either because the operator lifts the rudder 102 out of the water or because the underwater relief causes a large rudder rotation, the guide 142 is reset manually to the runner 138 by the operator.

Thus, the catamaran is amenable to facile knockdown. With the hulls 10 and 12 in parallel and side by side, the main spar 16 is placed in position between the two hulls over the threaded rods 70 central in the hulls and the knobs 96 are threaded over them by hand to secure the main spar in place. The stern spar 20 is then placed over the second set of two threaded rods 70' and knobs 96' likewise secure it in place. The trampoline 60 is then extended as a platform from the main spar 16 toward the stern spar 20 and stretched tight in connecting the plurality of trampoline straps 72 to the plurality of buckles 82 on the stern spar 20.

The rudder assemblies are also installed on the hull sterns 22 by engaging aligned pins 108 extending vertically from the mount plate 106 through receiving holes 146 in brackets 148 in the hull sterns 22 with the tiller 24 directed from the rudder 102 toward the stern spar 20 and the tiller arm 26 connected between distal ends of the tiller 24.

Before raising the mast, it is tied to the main spar 16 with the mast 18 alongside the main spar 16 by wrapping the cord 41 around the main spar 16 and passing it through the slot 42. The mast 14 is then raised by pulling the bow spar 28 into position between hulls at the catamaran bow with attached bow lines, lifting the mast with main sail attached from horizontal to vertical and attaching the bow spar 28 to the bow 150 of each hull 10 and 12 with the mast supported by cord 41 in the mast slot 42.

Having described the invention, what is claimed is as follows:

1. A catamaran having horizontal left and right hulls connected in parallel, a main sail on a mast, a jib, and a rudder assembly, the improvement comprising, a main spar releasably horizontally connected centrally between the two hulls, the mast removably attached thereto at a mast proximal end, a stern spar releasably connected horizontally between the two hulls at the catamaran astern from the main spar, a platform between the main spar and the stern spar, and wherein the rudder assembly comprises a rudder hingedly attached removably to each hull stem with a tiller extending from each rudder toward the rear spar, adapted to move the rudder on a vertical axis in steering the catamaran, and a tiller arm interconnecting the tillers at their distal end such that lateral movement of the tiller arm causes the rudders to move on their vertical axes, a bow spar releasably connected horizontally between the two hulls at the catamaran forward from the main spar, wherein the mast includes a vertical slot opening at the mast proximal end and further comprising a cord in a closed loop attaching the mast proximal end to the main spar by wrapping a lead portion of the loop from a main spar mast side around the main spar and back to the main spar mast side passing through a tail portion of the loop and then through the mast slot, the lead portion of the loop being releasably fastened in the mast slot, securing it alongside the main spar.

2. The catamaran of claim 1 further comprising a ball on the lead portion of the loop larger than the mast slot the fastens the loop lead portion in the slot by passing the lead portion of the loop under the mast and upward into the slot, the loop passing through the slot from the ball on one mast side to the main spar on the opposite mast side, the mast.

3. A catamaran having horizontal left and right hulls connected in parallel, a main sail on a mast, a jib, and a rudder assembly, the improvement comprising, a main spar releasably horizontally connected centrally between the two hulls, the mast removably attached thereto at a mast proximal end, a stern spar releasably connected horizontally between the two hulls at the catamaran astern from the main spar, a platform between the main spar and the stern spar, and wherein the rudder assembly comprises a rudder hingedly attached removably to each hull stem with a tiller extending from each rudder toward the rear spar, adapted to move the rudder on a vertical axis in steering the catamaran, and a tiller arm interconnecting the tillers at their distal end such that lateral movement of the tiller arm causes the rudders to move on their vertical axes, a bow spar releasably connected horizontally between the two hulls at the catamaran forward from the main spar, a plurality of trampoline straps extending from a trampoline rearward edge and ending in a fastener first part, a plurality of stern spar straps adjustable in length and extending from a stern spar forward edge and ending in a fastener second part adapted to engage the fastener first part, the trampoline tightened between the main spar and the stern spar by adjusting the length of the plurality of stern spar straps.

4. The catamaran of claim 3 wherein the trampoline further comprises a second trampoline loop at the trampoline rearward edge with a dowel running therethrough, disposed to distribute tension from the plurality of straps across the trampoline rearward edge.

5. The catamaran of claim 3 further comprising at least one looped jib strap sewn into the trampoline into which a jib can be quickly inserted and removed manually.

6. A catamaran having horizontal left and right hulls connected in parallel, a main sail on a mast, a jib, and a rudder assembly, the improvement comprising, a main spar releasably horizontally connected centrally between the two hulls, the mast removably attached thereto at a mast proximal end, a stern spar releasably connected horizontally between the two hulls at the catamaran astern from the main spar, a platform between the main spar and the stern spar, and wherein the rudder assembly comprises a rudder hingedly attached removably to each hull stern with a tiller extending from each rudder toward the rear spar, adapted to move the rudder on a vertical axis in steering the catamaran, and a tiller arm interconnecting the tillers at their distal end such that lateral movement of the tiller arm causes the rudders to move on their vertical axes, a bow spar releasably connected horizontally between the two hulls at the catamaran forward from the main spar, and a first set of two threaded rods upward from each hull over which matching holes in the main spar fit, removably secured thereon with main spar knobs with threaded holes that engage the threaded rods for quick, hand assembly and knockdown.

7. The catamaran of claim 6 further comprising a second set of two threaded rods upward from each hull over which matching holes in the stern spar fit, removably secured thereon with stern spar knobs with threaded holes that engage the threaded rods for quick, hand assembly and knockdown.

8. The method of assembling a catamaran amenable to facile knockdown from components that include left and right hulls having a first set of two threaded rods extending upward from each hull, centrally in the hull, a second set of two threaded rods upward from each hull astern in the hull, and a hinge first part on each hull stem disposed to hingedly receive a rudder assembly having a hinge second part; two rudder assemblies each with a hinge second part; a main sail on a mast that has vertical slot on one mast side at the mast proximal end longitudinal with the mast opening at the mast proximal end; a jib, a main spar with a pair of holes in each main spar end matching the first set of two threaded rods in each hull; a stern spar with a pair of holes in each main spar end matching the second set of two threaded rods in each hull; a trampoline secured to the main spar, a tiller arm; a bow spar, stern lines; and a bow line; a cord; a plurality of trampoline straps extending from a trampoline rearward edge and ending in a fastener first part; a plurality of stern spar straps adjustable in length and extending from a stern spar forward edge and ending in a fastener second part adapted to engage the fastener first part; a plurality of knobs with threaded holes matching the threaded rods of the hulls; comprising the following steps:

(a) with the hulls in parallel, connecting the two hulls with the main spar, the first set of two threaded rods upward from each hull passing through the pair of holes in each main spar end;

(b) removably threading knobs over first set of two threaded rods central in each hull;

(c) connecting the two hulls wit the stern spar, the second set of two threaded rods upward from each hull passing through the pair of holes in each stern spar end, as the mast attached to the stern spar by the stern lines is brought to the mast stern along with the bow stern also attached to the mast with a bow line;

(d) removably threading knobs over second set of two threaded rods astern in each hull;

(e) extending the trampoline as a platform from the main spar toward the stern spar and connecting the plurality of trampoline straps extending from a trampoline rearward edge by engaging the respective fastener first parts with the fastener second parts of the plurality of stern spar straps, (f) adjusting the straps in length to tighten the trampoline between the main and stern spars;

(g) hingedly attaching a rudder assembly to each hull stern by engaging the hinge first part on the hull stern with the hinge second part on the rudder assembly defining a hinge with a vertical axis on which the rudder swivels in steering the catamaran, with the tiller directed from the rudder toward the stern spar;

(h) connecting a tiller arm between distal ends of the tiller such that lateral movement of the tiller arm causes the rudders to move on their vertical axes;

(i) raising the mast with main sail attached from horizontal to vertical with the mast abutting the main spar perpendicularly through the bow line connected between the bow spar and the mast by pulling the bow spar forward and attaching it to the bow of each hull, stem lines connected between each of the first and second hulls sternward of the main spar and the mast intermediate its length and spaced apart from the main spar together with the bow line maintaining the mast vertical as guy lines.

9. The method of claim 8 further including the step tying the mast extension to the main spar with the mast alongside the main spar by wrapping the cord around the main spar and passing it through the slot, fastening it therein such that the cord passing through the slot is prevented from returning out of the slot back toward the main spar.

* * * * *